US008720812B2

(12) United States Patent
Liu et al.

(10) Patent No.: US 8,720,812 B2
(45) Date of Patent: May 13, 2014

(54) WINDING APPARATUS PROVIDING STEADY TENSION

(75) Inventors: Kuan-Chih Liu, Kaohsiung (TW); Chorng-Tyan Lin, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 199 days.

(21) Appl. No.: 13/252,265

(22) Filed: Oct. 4, 2011

(65) Prior Publication Data

US 2012/0138726 A1 Jun. 7, 2012

(30) Foreign Application Priority Data

Dec. 1, 2010 (TW) ..... 99141800 A

(51) Int. Cl.
*B65H 23/18* (2006.01)

(52) U.S. Cl.
USPC ..... 242/412.2; 242/413; 242/413.1; 242/413.9; 242/418.1; 242/419.1

(58) Field of Classification Search
USPC ..... 242/412.2, 413, 413.1, 413.3, 413.9, 242/417, 417.2, 418.1, 419.1, 421.4
See application file for complete search history.

(56) References Cited

U.S. PATENT DOCUMENTS

| | | | | |
|---|---|---|---|---|
| 4,159,808 | A * | 7/1979 | Meihofer | 242/413.1 |
| 4,708,301 | A * | 11/1987 | Kataoka | 226/44 |
| 5,251,834 | A * | 10/1993 | Ikegami et al. | 242/417 |
| 5,659,229 | A * | 8/1997 | Rajala | 318/6 |
| 5,911,383 | A | 6/1999 | Jacobsen et al. | |
| 5,941,473 | A * | 8/1999 | Kawano et al. | 242/413.1 |
| 6,039,286 | A | 3/2000 | Abrams et al. | |
| 7,164,251 | B2 | 1/2007 | Morishita | |
| 7,568,651 | B2 * | 8/2009 | Kessler | 242/418.1 |

FOREIGN PATENT DOCUMENTS

| | | |
|---|---|---|
| TW | 379199 | 1/2000 |
| TW | M367182 U | 10/2009 |

* cited by examiner

*Primary Examiner* — Sang Kim
(74) *Attorney, Agent, or Firm* — Alan Kamrath; Kamrath IP Lawfirm, P.A.

(57) ABSTRACT

A winding apparatus providing steady tension includes: a loading unit rotatably supporting a roll of a sheet, releasing the sheet, and outputting an angle signal and a torque signal; a winding unit adapted to collect the sheet into a roll form; a dancer roller and a tension sensing unit separately arranged between the loading unit and the winding unit and outputting a shift signal and a tension signal respectively; and a control module having a calculating unit and a command unit. The calculating unit electrically connects with the loading unit, the dancer roller and the tension sensing unit to receive the signals and generates a torque command signal. The command unit electrically connects with the calculating unit and the loading unit to receive the torque command signal and produces a control signal by the torque command signal or a velocity signal.

3 Claims, 3 Drawing Sheets

WINDING APPARATUS PROVIDING STEADY TENSION

BACKGROUND OF THE INVENTION

1. Field of the Invention

The present invention relates to a winding apparatus providing steady tension and, more particularly, to a winding apparatus providing steady tension by dynamic adjustment of loading according to the shift velocity of a dancer roller.

2. Description of the Related Art

Generally, winding apparatuses have been broadly applied to industries of textile, printing, paper-making, rolling, and flexible electronics. Tension, of a sheet in process has to be steadily maintained in order to prevent undue extension or creases. However, in loading and winding processes, it is not easy to maintain steady tension of the sheet, since an outer radius of a loading roll releasing the raw sheet is continuously decreasing while an outer radius of a winding roll collecting the processed sheet is continuously increasing. Therefore, how to control the torque of the loading roll to steadily maintain the tension of the sheet between the loading and winding rolls and thus to prevent undesired situations in releasing or collecting the sheet has become an important issue in the development of winding apparatuses.

For example, a conventional winding apparatus trying to provide a sheet with steady tension is disclosed by Taiwan Patent No. M367182, titled as "Auto-tension-decreasing Device." In operation of this conventional winding apparatus, necessary information about the sheet being processed, such as a total length, a thickness, and an initial tensional value, is necessary, so that rotational velocities of a loading roll and a winding roll can be controlled by a radius estimator and an auto-tension-controller to provide the sheet between the loading and winding rolls with steady tension. Besides, a tension detector is arranged between the loading roll and the winding roll to provide an actual tensional value of the sheet to the radius estimator as feedback. Thereby, the auto-tension-controller may adjust the rotational speeds of the rolls.

However, it is difficult to accurately measure the total length and thickness of the sheet, since the sheet is flexible and may have uneven thickness. An amount of calculating error will gradually increases as a total operation time increased if there is any error in the necessary information due to inaccurate measurement. Furthermore, the necessary information has to be updated once the material of the sheet is changed.

In light of this, it is desired to improve the conventional winding apparatus to simplify operation of the winding apparatus and to increase accuracy in tension control.

SUMMARY OF THE INVENTION

It is therefore the primary objective of this invention to provide a winding apparatus providing steady tension, which can dynamically adjust an actuator of a loading unit according to the velocity of a dancer roller, to simplify a prepare process before operation, avoid an increasing error, and provide an efficient online control.

Another objective of this invention is to provide a winding apparatus providing steady tension, which controls the loading unit by an advanced compensating torque to stably maintain the tension of a spread sheet released by the loading unit, to provide a high stability of loading and winding and to suppress the vibration of the spread sheet.

Still another objective of this invention is to provide a winding apparatus providing steady tension, which can be conveniently completed by modifying a conventional winding apparatus, to efficiently improve the loading/winding stability of this conventional winding apparatus.

The invention discloses a winding apparatus providing steady tension comprising a loading unit, a winding unit, a dancer roller, a tension sensing unit, a calculating unit and a command unit. The loading unit has a roller and an actuator. The roller is rotatable and is adapted to support a roll of a sheet and to release the sheet, and the roller sends out an angle signal corresponding to a rotation angle of the roller. The actuator connects with the roller and introduces an output torque to the roller, and the actuator outputs a torque signal corresponding to the output torque. The winding unit is adapted to collect the sheet into a roll form. The dancer roller is arranged between the loading unit and the winding unit and outputs a shift signal corresponding to a shift quantity of the dancer roller. The tension sensing unit is arranged between the loading unit and the winding unit and outputs a tension signal corresponding to a sensed tensional quantity of the sheet. The calculating unit electrically connects with the roller, the actuator, the dancer roller, and the tension sensing unit to receive the signals and generates a torque command signal. The command unit electrically connects with the actuator, the dancer roller and the calculating unit to receive the torque command signal and produces a control signal by the torque command signal or a velocity signal.

The invention also discloses a control module of a winding apparatus providing steady tension comprising a calculating unit and a command unit. The calculating unit electrically receives an angle signal, a torque signal, a shift signal and a tension signal, and generates a torque command signal by the signals. The command unit electrically connects with the calculating unit to receive the torque command signal, and produces a control signal by the torque command signal or a velocity signal.

Furthermore, the calculating unit has a directional filter, a first differentiator, a second differentiator, a divider, a torque calculator, and a subtracter. The directional filter connects with the dancer roller to obtain and output data of the shift signal in a predetermined direction. The first differentiator connects with the directional filter and differentiates an output of the directional filter to obtain the velocity signal. The second differentiator connects with the roller and differentiates the angle signal to obtain an angular velocity signal. The divider connects with the first and second differentiators to divide the velocity signal by the angular velocity signal. The torque calculator connects with the divider and the tension sensing unit to multiply an output of the divider by the tension signal. The subtracter connects with the torque calculator and the actuator and subtracts the torque signal from an output of the torque calculator to obtain the torque command signal.

Furthermore, the command unit has a compensating controller respectively connecting with the first differentiator and the subtracter of the calculating unit to separately acquire the velocity signal and the torque command signal. The compensating controller generates the control signal by the velocity signal when a ratio of a velocity in correspondence with the velocity signal to a predetermined velocity is outside a predetermined range, and generates the control signal by the torque command signal when the ratio is in the predetermined range.

Furthermore, the command unit has a directional filter, a differentiator, and a compensating controller. The directional filter connects with the dancer roller to obtain and output data of the shift signal in a predetermined direction. The differentiator connects with the directional filter and differentiates an output of the directional filter to obtain the velocity signal.

The compensating controller connects with the differentiator and the subtracter of the calculating unit to separately acquire the velocity signal and the torque command signal. The compensating controller generates the control signal by the velocity signal when a ratio of a velocity in correspondence with the velocity signal to a predetermined velocity is outside a predetermined range, and generates the control signal by the torque command signal when the ratio is in the predetermined range.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
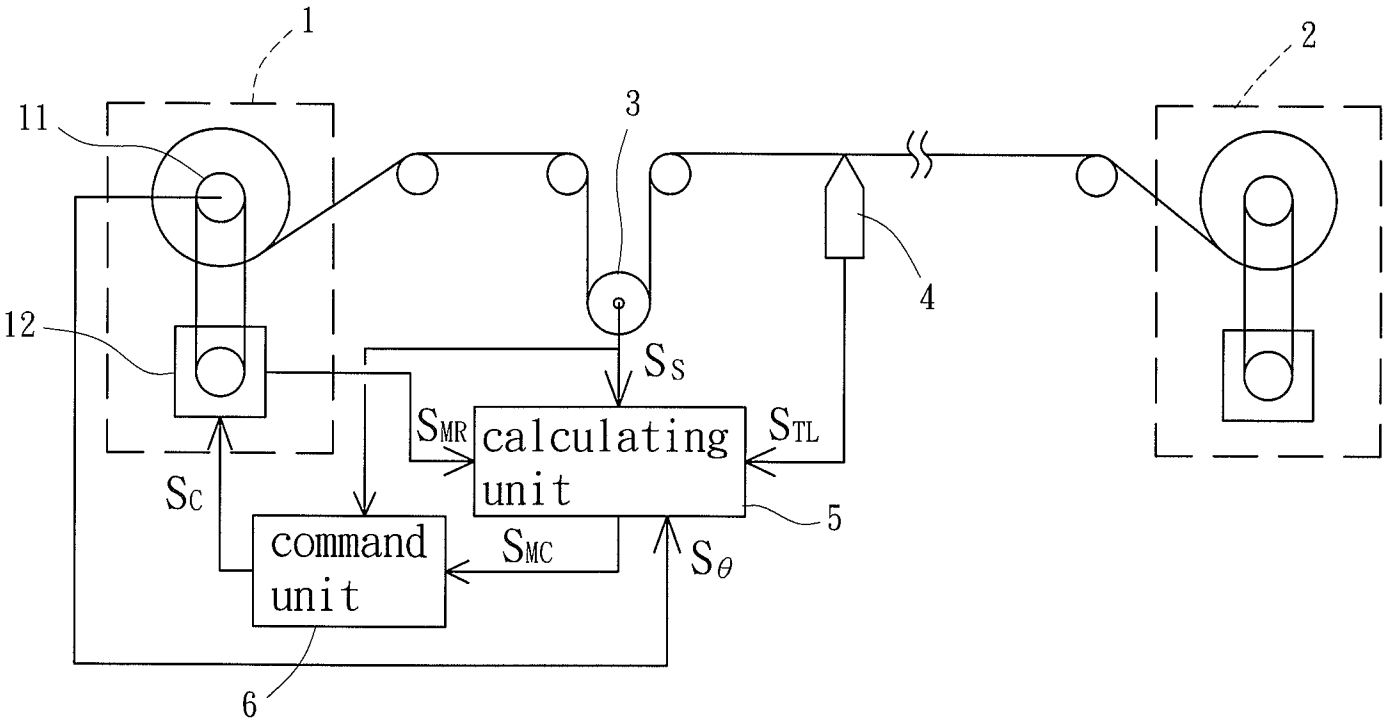
FIG. 1 shows a sketch diagram of a winding apparatus providing steady tension according to a preferred embodiment of the invention.

In the various figures of the drawings, the same numerals designate the same or similar parts. Furthermore, when the terms "first," "second" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Referring to FIG. 1, a sketch diagram of a preferred embodiment of a winding apparatus providing steady tension is shown. The winding apparatus has a loading unit 1, a winding unit 2, a dancer roller 3, a tension sensing unit 4, a calculating unit 5, and a command unit 6, with the calculating unit 5 and command unit 6 jointly forming a control module. The control module controls the loading unit 1 by feedback control via a plurality of signals provided by the loading unit 1, the dancer roller 3, and the tension sensing unit 4, to maintain the tension of the spread sheet between the loading and winding units 1, 2 steady.

The loading unit 1 rotatably carries a roll of a sheet and is able to release the sheet. The loading unit 1 includes a roller 11 and an actuator 12. The roller 11 firmly supports the roll of the sheet and can rotate relative to other parts of the loading unit 1 while sending out an angle signal "$S_0$" corresponding to a rotation angle "θ" of the roller 11, and the actuator 12 connects with the roller 11 to introduce an output torque "$M_R$" to the roller 11 and outputs a torque signal "$S_{MR}$" corresponding to the output torque "$M_R$." Specifically, the actuator 12 is a device able to output rotational power such as a motor.

The winding unit 2 collects the sheet to wind it back into a roll form, and the sheet is spread between the loading and winding units 1, 2 for being processed.

The dancer roller 3 is arranged between the loading unit 1 and winding unit 2 and is rotatably hung on the spread sheet between the loading and winding units 1, 2. The dancer roller 3 can output a shift signal "$S_s$" corresponding to a shift quantity "S" of itself.

The tension sensing unit 4 is also arranged between the loading unit 1 and winding unit 2 to sense a tensional quantity "$T_L$" of the spread sheet between the loading and winding units 1, 2 and output a tension signal "$S_{TL}$" corresponding to the tensional quantity "$T_L$."

Figure 2:
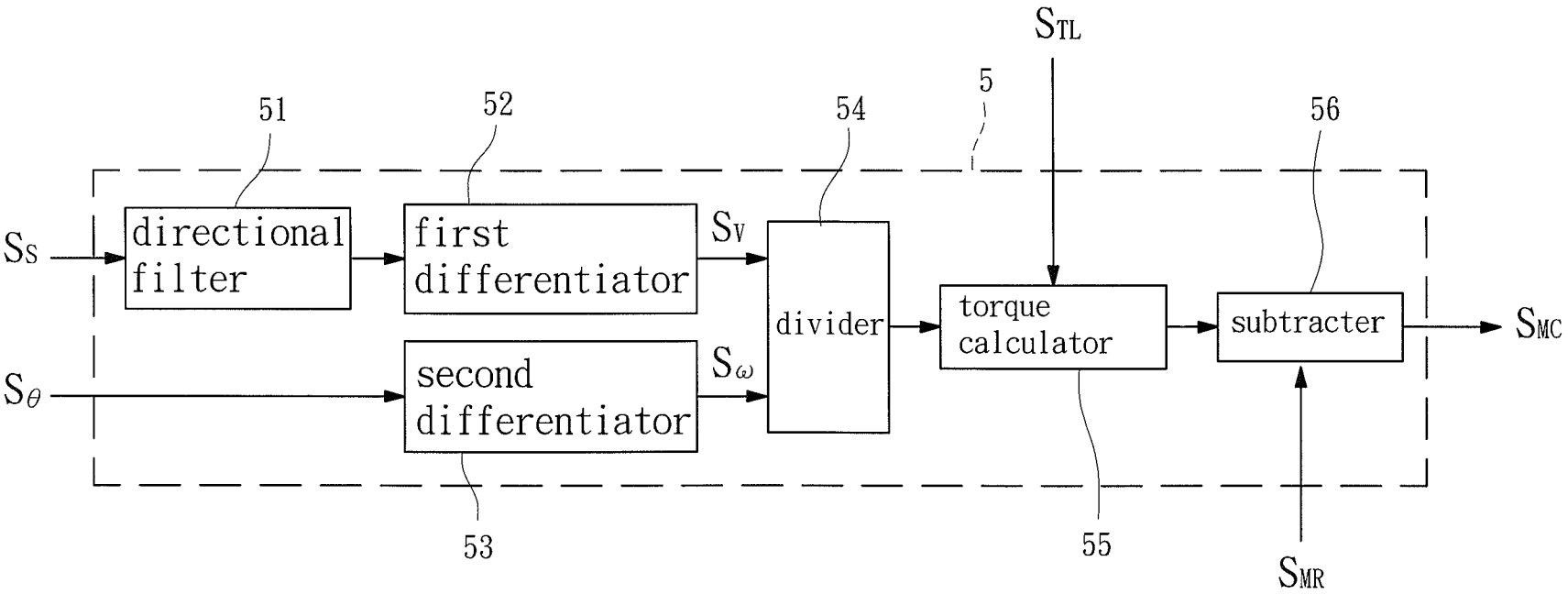
FIG. 2 shows a sketch diagram of a calculating unit of the winding apparatus providing steady tension according to the preferred embodiment of the invention.

Referring to FIGS. 1 and 2, the calculating unit 5 electrically connects with the roller 11, the actuator 12, the dancer roller 3, and the tension sensing unit 4 to receive the signals "$S_\theta$," "$S_{MR}$," "$S_S$," "$S_{TL}$" and accordingly generates a torque command signal "$S_{MC}$." Particularly, an equation of the relationship between a radius "R," a velocity "$V_T$" and an angular velocity "ω" is shown as the following:

$$R = \frac{kV_T}{\omega}, \tag{1}$$

wherein the radius "R" represents a distance from a rotational axis of the roller 11 to an outmost part of the sheet which is still wound around the roller 11, the velocity "$V_T$" represents a velocity of the dancer roller 3 in a predetermined direction such as the gravity direction, and the angular velocity "ω" represents an angular velocity of the roller 11, with the "k" representing a constant. Furthermore, there is a relationship between the tensional quantity "$T_L$," the radius "R" and a demanded torque "M" that has to be introduced by the actuator 12 shown as the following:

$$M = \frac{RT_L}{2}. \tag{2}$$

According to the above equations (1) and (2), the following equation (3) shows the demanded torque "M" as:

$$M = \frac{kV_T T_L}{2\omega}. \tag{3}$$

Consequently, when the torque command signal "$S_{MC}$" generated by the calculating unit 5 operates the actuator 12 to output the output torque "$M_R$" equal to the demanded torque "M," the tensional quantity "$T_L$" of the spread sheet between the loading and winding units 1, 2 can be stably held.

Therefore, with the above conclusion, the calculating unit 5 is designed to have a directional filter 51, a first differentiator 52, a second differentiator 53, a divider 54, a torque calculator 55, and a subtracter 56. The directional filter 51 connects with the dancer roller 3 to receive the shift signal "$S_S$" and obtains and outputs data of the shift signal "$S_S$" in the predetermined direction. In this embodiment shown by FIG. 1, the directional filter 51 filters out data of the shift signal "$S_S$" other than those in a downward direction identical to the gravity direction. The first differentiator 52 connects with the directional filter 51 and differentiates an output of the directional filter 51, to obtain a velocity signal "$S_V$" in correspondence with the velocity "$V_T$" of the dancer roller 3. The second differentiator 53 connects with the roller 11 to receive and differentiate the angle signal "$S_\theta$" to obtain an angular velocity signal "$S_\omega$" in correspondence with the angular velocity "ω" of the roller 11. The divider 54 connects with the first and second differentiators 52, 53 to divide the velocity signal "$S_V$" by the angular velocity signal "$S_\omega$." The torque calculator 55 connects with the divider 54 and the tension sensing unit 4 to receive an output of the divider 54 and the tension signal "$S_{TL}$" of the tension sensing unit 4. The torque calculator 55 further multiplies the output of the divider 54 by the tension signal "$S_{TL}$" to obtain an output signal in correspondence with the demanded torque "M." Finally, the subtracter 56 connects with the torque calculator 55 and the actuator 12, subtracts the torque signal "$S_{MR}$" of the actuator 12 from the output signal of the torque calculator 55, and obtains the torque command signal "$S_{MC}$" for the command unit 6.

Figure 3:
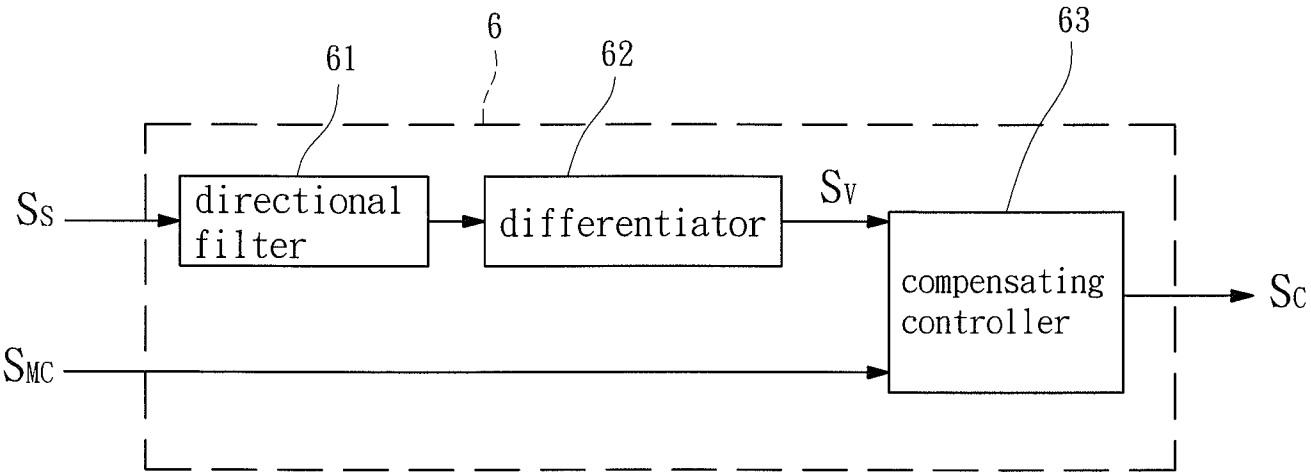
FIG. 3 shows a sketch diagram of a command unit of the winding apparatus providing steady tension according to the preferred embodiment of the invention.

Referring to FIGS. 1 and 3, the command unit 6 is electrically connected with the actuator 12 of the loading unit 1, the dancer roller 3, and the calculating unit 5, so that the command unit 6 may produce a control signal "$S_C$" by the shift signal "$S_S$" or the torque command signal "$S_{MC}$" and send the control signal "$S_c$" to the actuator 12 of the loading unit 1 to take the demanded torque "M" as the output torque "$M_R$." In detail, the command unit 6 has a directional filter 61, a differentiator 62, and a compensating controller 63, and there is a predetermined velocity "V" set in the command unit 6 previously. The directional filter 61 and the differentiator 62 are sequentially connected with the dancer roller 3, with the way that the directional filter 61 and the differentiator 62 operate being identical to that of the directional filter 51 and the first differentiator 52 of the calculating unit 5, so that the differentiator 62 can also output the velocity signal "$S_V$." The compensating controller 63 connects with the differentiator 62 and the subtracter 56 respectively to receive the velocity signal "$S_V$" and the torque command signal "$S_{MC}$," and determines whether a ratio of the velocity "$V_T$" in correspondence with the velocity signal "$S_V$" to the predetermined velocity "V" is in a predetermined range or not. The compensating controller 63 is in a velocity control mode to generate the control signal "$S_C$" according to the velocity signal "$S_V$" when the ratio of the velocity "$V_T$" to the predetermined velocity "V" is outside the predetermined range, and the compensating controller 63 is in a torque control mode to generate the control signal "$S_c$" according to the torque command signal "$S_{MC}$" when the ratio of the velocity "$V_T$" to the predetermined velocity "V" is in the predetermined range. The predetermined range is preferably 95%-105% of the predetermined velocity "V." Furthermore, the way to generate the control signal "$S_C$" by the velocity signal "$S_V$" or the torque command signal "$S_{MC}$" can be a conventional control method such as the proportional error control, the proportional control, the integral control, or the differential control. Alternatively, instead of having the directional filter 61 and differentiator 62, the command unit 6 can only have the compensating controller 63, with the compensating controller 63 connecting with the first differentiator 52 and subtracter 56 to separately acquire the velocity signal "$S_V$" and the torque command signal "$S_{MC}$."

With the control module including the calculating unit 5 and the command unit 6, the compensating controller 63 of the command unit 6 is in the velocity control mode when the winding apparatus is just started and the ratio of the velocity "$V_T$" to the predetermined velocity "V" is outside the predetermined range, to continuously increase the output torque "$M_R$" of the actuator 12 by adjusting the control signal "$S_C$". Thus, the velocity "$V_T$" of the dancer roller 3 may be close to the predetermined velocity "V" gradually. The compensating controller 63 may then be in the torque control mode once the ratio of the velocity "$V_T$" to the predetermined velocity "V" is in the predetermined range, which means that the tension of the spread sheet between the loading and winding units 1, 2 is held at a designed value. Thus, the torque command signal "$S_{MC}$" can control the actuator 12 through the command unit 6 to maintain the tension of the spread sheet. Thereby, the tension of the sheet in process can be directly held without any previous measured information of the sheet. Moreover, the present winding apparatus can also be conveniently completed by modifying a conventional winding apparatus only having the loading unit 1 and the winding unit 2, since the dancer roller 3 and the tension sensing unit 4 do not have to be structurally mounted on those conventional members and since the control module merely connects with the loading unit 1 by electrical connection.

In sum, the present winding apparatus can obtain the demanded torque "M" of the actuator 12 only by dynamic information, such as the velocity "$V_T$" of the dancer roller 3, the angular velocity "ω" of the roller 11, and the tensional quantity "$T_L$" of the spread sheet, to make the tension of the spread sheet processed between the loading unit 1 and the winding unit 2 steady.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A winding apparatus providing steady tension, comprising:

a loading unit having a roller and an actuator, wherein the roller is rotatable and is adapted to support a roll of a sheet and to release the sheet, the roller sends out an angle signal corresponding to a rotation angle of the roller, the actuator connects with the roller and introduces an output torque to the roller, and the actuator outputs a torque signal corresponding to the output torque;

a winding unit adapted to collect the sheet into a roll form;

a dancer roller arranged between the loading unit and the winding unit and outputting a shift signal corresponding to a shift quantity of the dancer roller;

a tension sensing unit arranged between the loading unit and winding unit and outputting a tension signal corresponding to a sensed tensional quantity of the sheet;

a calculating unit electrically connecting with the roller, the actuator, the dancer roller, and the tension sensing unit to receive the signals and generating a torque command signal; and a command unit electrically connecting with the actuator, the dancer roller and the calculating unit to receive the torque command signal and producing a control signal by the torque command signal or a velocity signal, wherein the calculating unit has a directional filter, a first differentiator, a second differentiator, a divider, a torque calculator, and a subtracter, the directional filter connects with the dancer roller to obtain and output data of the shift signal in a predetermined direction, the first differentiator connects with the directional filter and differentiates an output of the directional filter to obtain the velocity signal, the second differentiator connects with the roller and differentiates the angle signal to obtain an angular velocity signal, the divider connects with the first and second differentiators to divide the velocity signal by the angular velocity signal, the torque calculator connects with the divider and the tension sensing unit to multiply an output of the divider by the tension signal, and the subtracter connects with the torque calculator and the actuator and subtracts the torque signal from an output of the torque calculator to obtain the torque command signal.

2. The winding apparatus providing steady tension as claimed in claim 1, wherein the command unit has a compensating controller respectively connecting with the first differentiator and the subtracter of the calculating unit to separately acquire the velocity signal and the torque command signal, the compensating controller generates the control signal by the velocity signal when a ratio of a velocity in correspondence with the velocity signal to a predetermined velocity is outside a predetermined range, and the compensating controller generates the control signal by the torque command signal when the ratio is in the predetermined range.

3. A winding apparatus providing steady tension, comprising:

a loading unit having a roller and an actuator, wherein the roller is rotatable and is adapted to support a roll of a sheet and to release the sheet, the roller sends out an angle signal corresponding to a rotation angle of the roller, the actuator connects with the roller and introduces an output torque to the roller, and the actuator outputs a torque signal corresponding to the output torque;

a winding unit adapted to collect the sheet into a roll form;

a dancer roller arranged between the loading unit and the winding unit and outputting a shift signal corresponding to a shift quantity of the dancer roller;

a tension sensing unit arranged between the loading unit and winding unit and outputting a tension signal corresponding to a sensed tensional quantity of the sheet;

a calculating unit electrically connecting with the roller, the actuator, the dancer roller, and the tension sensing unit to receive the signals and generating a torque command signal; and a command unit electrically connecting with the actuator, the dancer roller and the calculating unit to receive the torque command signal and producing a control signal by the torque command signal or a velocity signal, wherein the command unit has a directional filter, a differentiator, and a compensating controller, the directional filter connects with the dancer roller to obtain and output data of the shift signal in a predetermined direction, the differentiator connects with the directional filter and differentiates an output of the directional filter to obtain the velocity signal, the compensating controller connects with the differentiator and the subtracter of the calculating unit to separately acquire the velocity signal and the torque command signal, the compensating controller generates the control signal by the velocity signal when a ratio of a velocity in correspondence with the velocity signal to a predetermined velocity is outside a predetermined range, and the compensating controller generates the control signal by the torque command signal when the ratio is in the predetermined range.

* * * * *